US005366293A

United States Patent [19]

Lii

[11] Patent Number: 5,366,293

[45] Date of Patent: Nov. 22, 1994

[54] HANDBAG PARTIALLY CONVERTIBLE INTO A LONG CORD FOR EMERGENCY USE

[76] Inventor: Shyr-Dong Lii, No. 4-1, Chung-Nan Lane, Kuang-Hsing Rd., Tai-Ping Hsiang, Taichung Hsien, Taiwan, Prov. of China

[21] Appl. No.: 163,302

[22] Filed: Dec. 7, 1993

[51] Int. Cl.[5] ..... B65D 30/06

[52] U.S. Cl. ..... 383/13; 383/4; 383/40; 383/117; 66/170

[58] Field of Search ..... 383/12, 13, 4, 40, 117, 383/902; 66/169 R, 170

[56] References Cited

U.S. PATENT DOCUMENTS

| | | | |
|---|---|---|---|
| 954,113 | 4/1910 | Kraemer | 383/117 |
| 2,393,268 | 1/1946 | Rotkel | 66/170 |
| 3,807,200 | 4/1974 | Liwski | 66/170 |
| 4,662,517 | 5/1987 | Wirth | 383/4 X |
| 4,713,033 | 12/1987 | Cameron | 383/3 X |
| 4,795,268 | 1/1989 | Jordá | 383/40 |

FOREIGN PATENT DOCUMENTS

| | | | |
|---|---|---|---|
| 0013783 | of 1893 | United Kingdom | 383/40 |

*Primary Examiner*—Allan N. Shoap
*Assistant Examiner*—Jes F. Pascua
*Attorney, Agent, or Firm*—Morgan & Finnegan

[57] ABSTRACT

A handbag is partially convertible into a long cord for emergency use and includes a frame unit and a pocket unit. The frame unit has a hollow body which includes a bracket member on the lower portion thereof, and two handle members respectively secured to the upper portions of two opposite sides of the bracket member. The pocket unit includes a pocket body which is knitted or crocheted from the cord and which is mounted removably on the hollow body of the frame unit, and two fasteners which are respectively secured to two end portions of the cord and which are locked in the pocket body. The cord has a predetermined length so as to be knitted or crocheted into the pocket body. Accordingly, when the pocket unit is removed from the frame unit, the fasteners of the pocket unit can be unlocked from the pocket body so as to pull outward the end portions of the cord, thereby untying the cord. In addition, the handbag further includes an exterior pocket attached to the outside wall of the hollow body between the bracket member and the handle members.

4 Claims, 7 Drawing Sheets

HANDBAG PARTIALLY CONVERTIBLE INTO A LONG CORD FOR EMERGENCY USE

BACKGROUND OF THE INVENTION

1. Field of the Invention

This invention relates to a handbag, more particularly to a handbag with a pocket body that can be converted into a long cord for emergency use.

2. Description of the Related Art

Generally speaking, a conventional handbag can be manufactured by several different methods. For example, it can be formed integrally from a plastic material, made up of leather, or knitted or crocheted from woollen ropes. However, the conventional handbag is used only to carry one's money or personal things therein. Accordingly, the practicability of the conventional handbag is limited.

SUMMARY OF THE INVENTION

The main objective of this invention is to provide a handbag which has a pocket body that can be converted into a long cord for use in case of emergency.

According to this invention, a handbag is partially convertible into a long cord for emergency use and includes a frame unit and a pocket unit. The frame unit has a hollow body which includes a bracket member on the lower portion thereof, and two handle members respectively secured to the upper portions of two opposite sides of the bracket member. The pocket united includes a pocket body which is knitted or crocheted from the cord and which is mounted removably on the hollow body of the frame unit, and two fasteners which are respectively secured to two end portions of the cord and which are locked in the pocket body. The cord has a predetermined length so as to be knitted or crocheted into the pocket body. Accordingly, when the pocket unit is removed from the frame unit, the fasteners of the pocket unit can be unlocked from the pocket body so as to pull outward the end portions of the cord, thereby untying the cord. In one embodiment, the handbag further includes an exterior pocket attached to the outside wall of the hollow body between the bracket member and the handle members.

BRIEF DESCRIPTION OF THE DRAWING

Other features and advantages of this invention will become apparent in the following detailed description of a preferred embodiment of this invention, with reference to the accompanying drawing, in which.

DETAILED DESCRIPTION OF THIS PREFERRED EMBODIMENT

Figure 1:
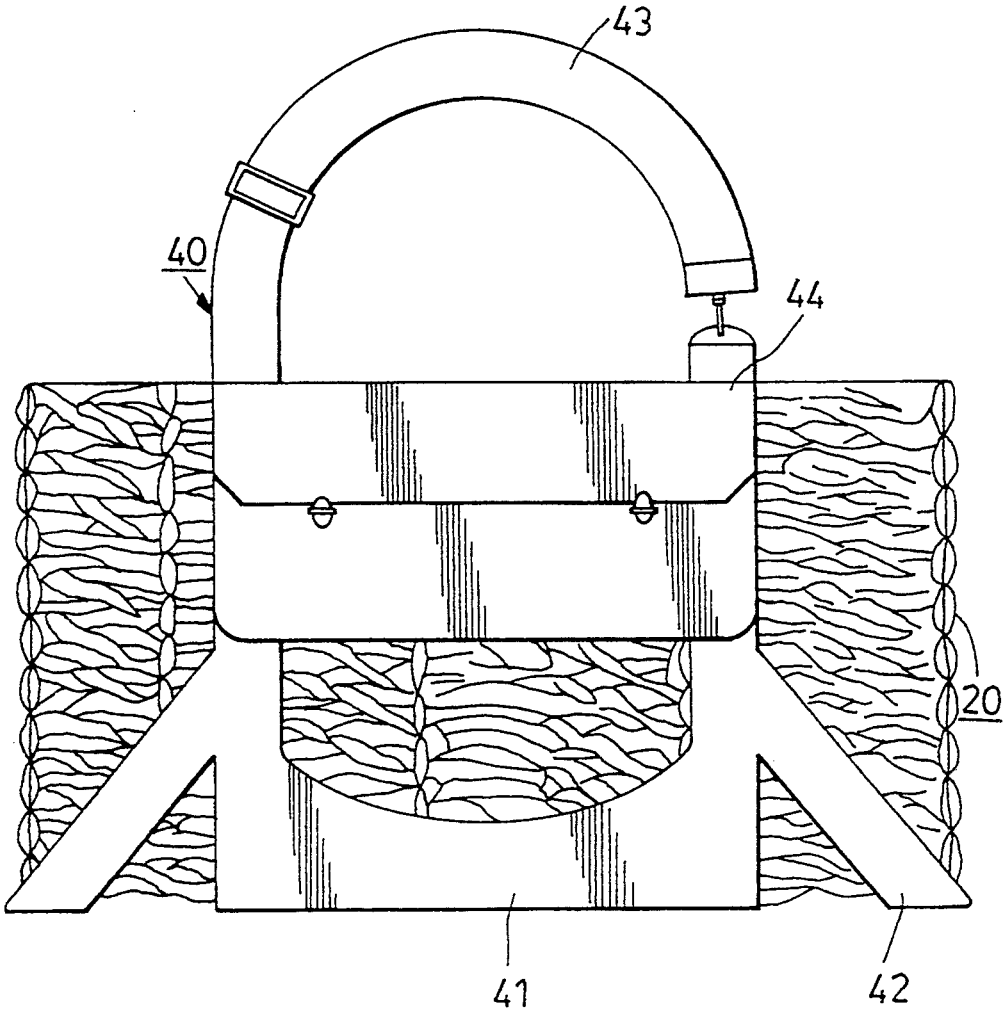
FIG. 1 is an elevational side view showing a handbag of the preferred embodiment of this invention which consists of a frame unit and a pocket unit that is mounted removably on the frame unit.

Referring to FIG. 1, a handbag of the preferred embodiment of this invention includes a frame unit 40 and a pocket unit 20.

Figure 2:
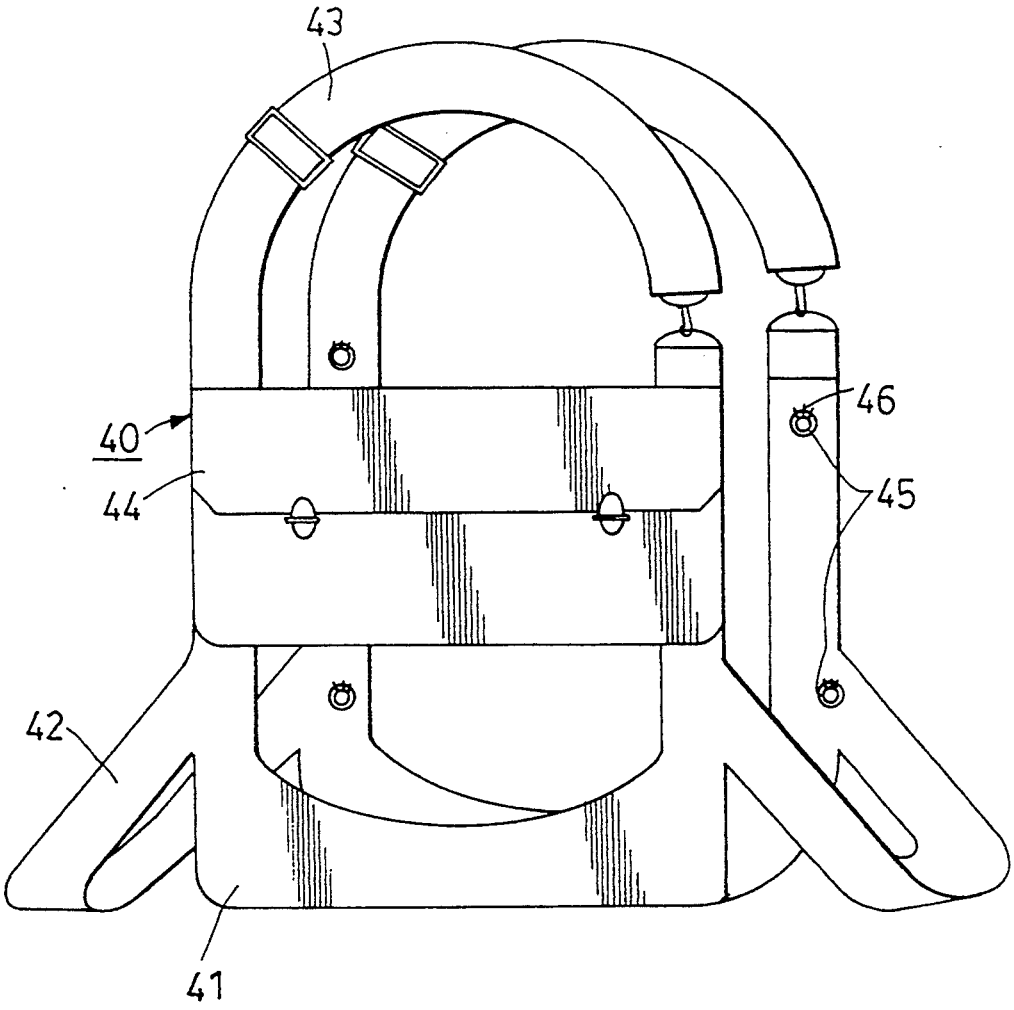
FIG. 2 is a perspective view showing the frame unit of the handbag which has several rings secured thereto in accordance with this invention.

The frame unit 40, as shown in FIG. 2, has a hollow body which includes an elongated bracket member 41 on the lower portion thereof, and two positioning members 42 formed respectively and integrally with the end portions of the bracket member 41. The bracket member 41 and the positioning member 42 are used to support the pocket unit 20 when the pocket unit 20 is disposed on the hollow body of the frame unit 40. Two handle members 43 are respectively and adjustably connected to the upper portions of two opposite sides of the bracket member 41. An exterior pocket 44 is attached to the outside wall of the hollow body of the frame unit 40 between the bracket member 41 and the handle members 43. The frame unit 40 further includes several rings 45 (only four are shown) which are sewed on the inside wall of the hollow body with several threads 46.

Figure 3:
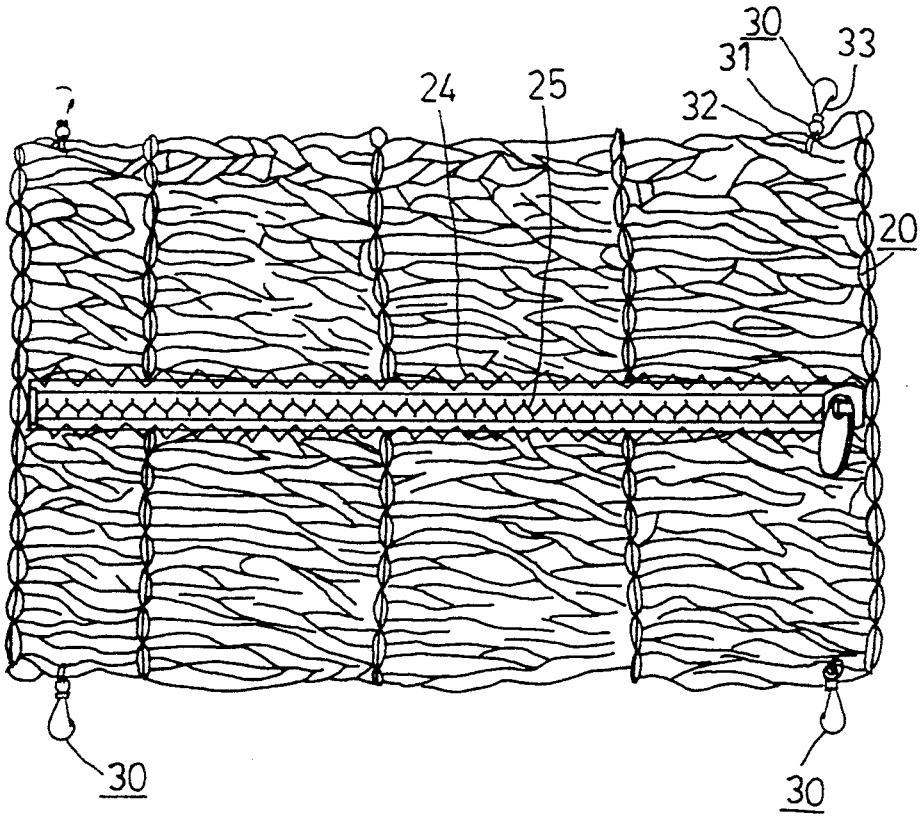
FIG. 3 is an elevational top view showing the pocket unit of the handbag which has several fasteners secured thereto in accordance with this invention.
Figure 4:
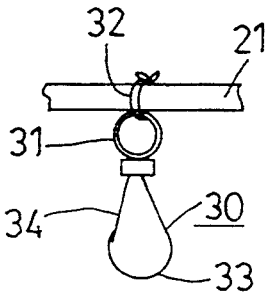
FIG. 4 is a schematic view illustrating how the fasteners are secured to the pocket unit of this invention.
Figure 6:
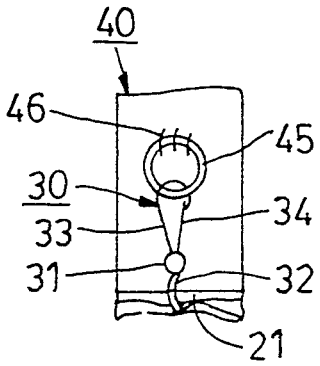
FIG. 6 is a schematic view illustrating how the fastener of the pocket unit is locked on the ring of the frame unit in accordance with this invention.

Referring to FIG. 3, the pocket unit 20 includes a pocket body which is knitted or crocheted from a cord 21 (see FIG. 7), and several fasteners 30 (only four are shown) which are respectively secured to the pocket body. Each of the fasteners 30, as shown in FIG. 4, functions as a spring hook and includes an annular portion 31 which is tied on the cord 21 by means of a thread 32, and a hook portion 33 which is mounted securely to the annular portion 31 and which is closed at the distal end by a spring snap 34. The spring snap 34 is opened by pressing inward so as to allow the hook portion 33 of the fastener 30 to be held on the corresponding ring 45 of the frame unit 40, as shown in FIG. 6.

Figure 5:
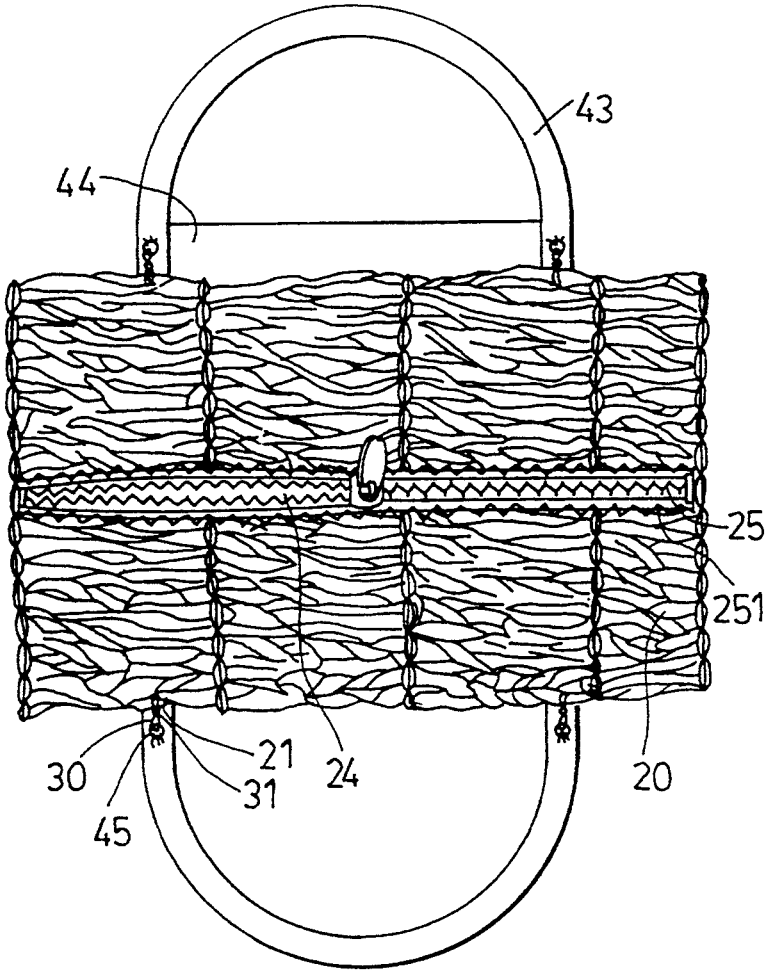
FIG. 5 is a schematic view illustrating the combination of the pocket unit and the frame unit of the handbag according to this invention.

Referring to FIG. 5, the connection between the fasteners 30 and the rings 45 enables the pocket body of the pocket unit 20 to be mounted removably on the hollow body of the frame unit 40. The pocket body of the pocket unit 20 has an elongated opening 24 formed in the top surface thereof, and a zipper fastener 25 sewed on the pocket unit 20 on two sides of the opening 24 by means of several thin threads 251 so as to close the opening 24 by joining the teeth of the zipper fastener 25 together.

Figure 7:
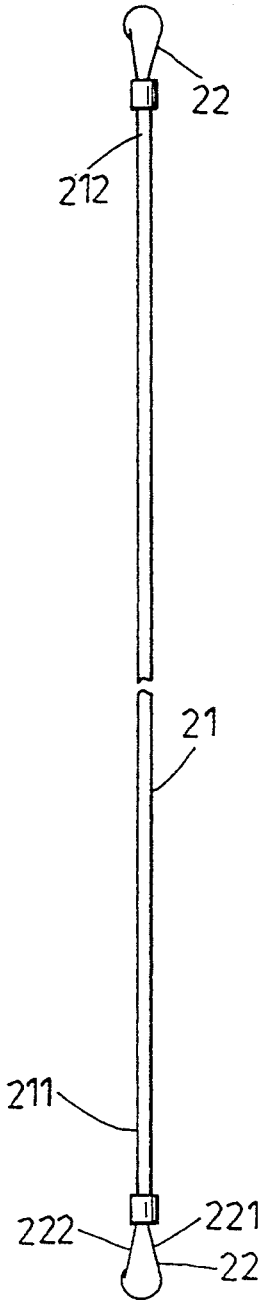
FIG. 7 shows a cord which has a predetermined length and which is to be knitted or crocheted into the pocket unit of the handbag of this invention.
Figure 8:
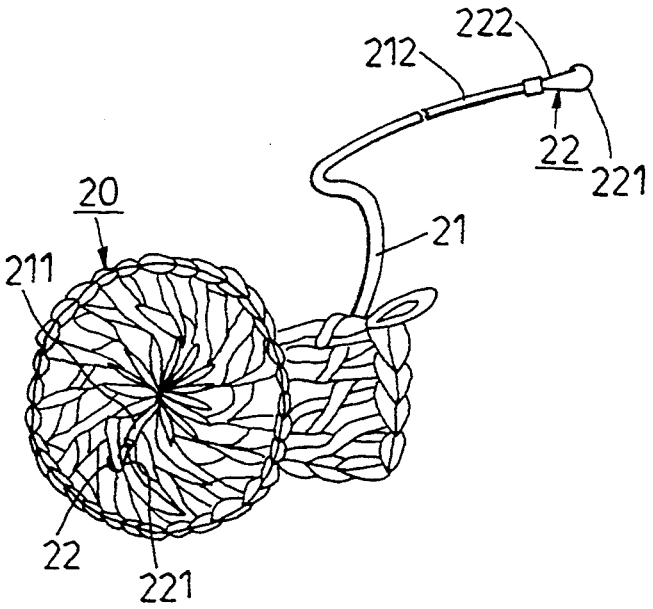
FIG. 8 is a schematic view illustrating how to crochet the cord into the pocket unit.

The cord 21, as shown in FIG. 7, has a predetermined length so as to be knitted or crocheted into the pocket body and includes two fasteners 22 which are respectively secured to two end portions 211, 212 of the cord 21. Each of the fasteners 22 is similar to the fasteners 30 in construction and also has a hook portion 221 and a spring snap 222 which is used to close the distal end of the hook portion 221. Referring to FIG. 8, the fasteners 22 of the cord 21 have to be locked in the pocket body of the pocket unit 20 so as to constitute the pocket body.

Figure 9:
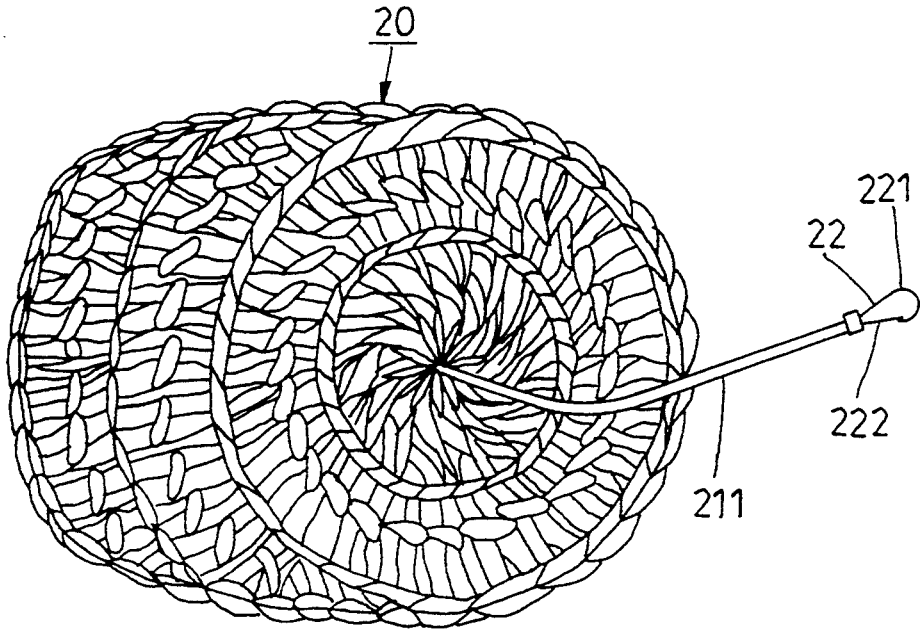
FIG. 9 is a schematic view illustrating how the cord is untied.

When it is desired to use the cord 21 in an emergency, the pocket unit 20 has to be removed from the frame unit 40. Then, the zipper fastener 25 is torn from the pocket body of the pocket unit 20. At this time, one of the fasteners 22 of the cord 21, as shown in FIG. 9, can be unlocked from the pocket body of the pocket unit 20 so as to pull outward the end portion 211 of the cord, thereby untying the cord 21. In this way, the pocket body can be converted into the form of the cord 21, as shown in FIG. 7, in order to be used as a lifesaving appliance.

With this invention thus explained, it is apparent that numerous modifications and variations can be made without departing from the scope and spirit of this invention. It is therefore intended that this invention be limited only as indicated in the appended claims.

I claim:

1. A handbag with an elongated cord, said handbag comprising:

a frame unit having a hollow body which includes a bracket member on a lower portion thereof, and two handle members respectively secured to upper portions of two opposite sides of said bracket member; and a pocket unit including a pocket body which is knitted from said cord and which is mounted removably on said hollow body of said frame unit, and two fasteners having hook portions which are respectively secured to two end portions of said cord, the hook portions of which are locked in said pocket body, said cord having a predetermined length so as to be knitted into said pocket body;

whereby, when said pocket unit is removed from said frame unit, said fasteners of said pocket unit can be unlocked from said pocket body so as to pull outward said end portions of said cord, thereby unravelling said pocket body.

2. A handbag as claimed in claim 1, wherein said frame unit has several rings mounted securely on said hollow body, said pocket unit having several fasteners secured to said pocket body, each of said fasteners being locked on a respective one of said rings of said frame unit so that said pocket unit is mounted removably on said hollow body of said frame unit.

3. A handbag as claimed in claim 1, wherein said handbag further includes an exterior pocket attached to an outside wall of said hollow body between said bracket member and said handle members.

4. A handbag as claimed in claim 1, wherein said pocket body is crocheted from said cord.

* * * * *